United States Patent [19]

Wilson

[11] Patent Number: 4,497,390

[45] Date of Patent: Feb. 5, 1985

[54] SELF-ADJUSTING LADDER

[76] Inventor: Frederick D. Wilson, 630 Ramsier Dr., Hendersonville, N.C. 28739

[21] Appl. No.: 497,121

[22] Filed: May 23, 1983

[51] Int. Cl.[3] ..... E06C 7/44

[52] U.S. Cl. ..... 182/202; 248/188.3

[58] Field of Search ..... 182/202; 248/188.3, 248/188.2

[56] References Cited

U.S. PATENT DOCUMENTS

| | | | |
|---|---|---|---|
| 1,551,395 | 8/1925 | Husted | 182/202 |
| 2,969,126 | 1/1961 | Gardner | 182/202 |
| 3,090,466 | 5/1963 | Wright | 182/202 |
| 3,102,606 | 9/1963 | Hopfeld | 182/202 |
| 3,794,141 | 2/1974 | Sturm | 182/202 |
| 3,880,388 | 4/1975 | Beguin | 182/202 |
| 4,095,671 | 6/1978 | Iorristal | 182/202 |

FOREIGN PATENT DOCUMENTS

| | | | |
|---|---|---|---|
| 183886 | 5/1963 | Sweden | 182/202 |

*Primary Examiner*—Reinaldo P. Machado
*Attorney, Agent, or Firm*—David M. Carter

[57] ABSTRACT

There is provided a self-leveling ladder which is particularly useful on uneven surfaces. The ladder includes an attachment generally U-shaped in form having parallel tubes which are secured to the bottom portion of the legs of the ladder and a tubular bridging mechanism connecting the parallel tubes. Legs are received in the bottom portion of each parallel tube and a plurality of balls are received in the bridge portion and the top portion of the tubes. The balls act to transfer the force from one leg to the other so that when the bottom of the legs are placed on different levels the ladder will automatically level itself.

1 Claim, 2 Drawing Figures

SELF-ADJUSTING LADDER

BACKGROUND OF THE INVENTION

This invention relates to ladders with adjustable legs. More particularly, it relates to a ladder which is automatically self-leveling.

There has been a long-felt need in the ladder industry to have a ladder which is safe to use on surfaces which are uneven, such as on a hillside. Various ladders have been designed which have telescoping, adjustable legs for such a purpose. One example of such a ladder is shown in U.S. Pat. No. 1,117,069 issued to Vero et al. The Vero ladder utilizes telescoping legs with a series of ratchets along the inner peripheral surface of the channels along the side of the ladder. These ratchets provide for discreet movement of the legs. Thus one of the drawbacks of the Vero ladder is that it is only adjustable to those discreet lengths as dictated by the distance between the ratchets. Furthermore, each time the ladder is moved to a slope of a different angle, the ladder must be adjusted once again. Thus the Vero ladder is not self-adjusting. Therefore, it is believed that lack of the self-adjusting feature has prevented adjustable ladders from becoming commonplace in the market.

OBJECTS OF THE INVENTION

It is therefore one object of this invention to provide an improved adjustable ladder.

It is another object to provide a ladder having self-adjusting legs.

It is still another object to provide a ladder with self-adjusting legs which requires no manipulation of the legs.

It is still another object to provide a ladder having adjustable legs which is inexpensive to manufacture and convenient to use.

It is still another object of this invention to provide a mechanism for forming a self-adjusting ladder which may be either retrofitted to existing ladders or manufactured together with a new ladder.

If is a further object to provide a mechanism for providing a self-adjusting ladder or ladders of various sizes.

SUMMARY OF THE INVENTION

In accordance with one form of this invention there is provided a mechanism for making a ladder self-adjusting, including a U-shaped hollow tubular member which is coupled rigidly to the bottom portion of the ladder. The tubular member includes parallel channels and a bridge connecting the tops of the channels. A pair of rods are slidably received in each of the parallel channels. A plurality of balls are movably received in the bridge channel and the tops of the parallel channels. The bottoms of each rod contact the normal supporting surfaces for the ladder. A portion of each rod extends from the open end of its respective channel. The length of the portion of each rod which extends from the open end of the respective channels depends on the relative level of the respective surface on which the bottom of each rod contacts. The tops of each rod contact a ball. A mechanism may be used for different sizes of ladders by making the bridge channel flexible.

DESCRIPTION OF THE PREFERRED EMBODIMENTS

Figure 1:
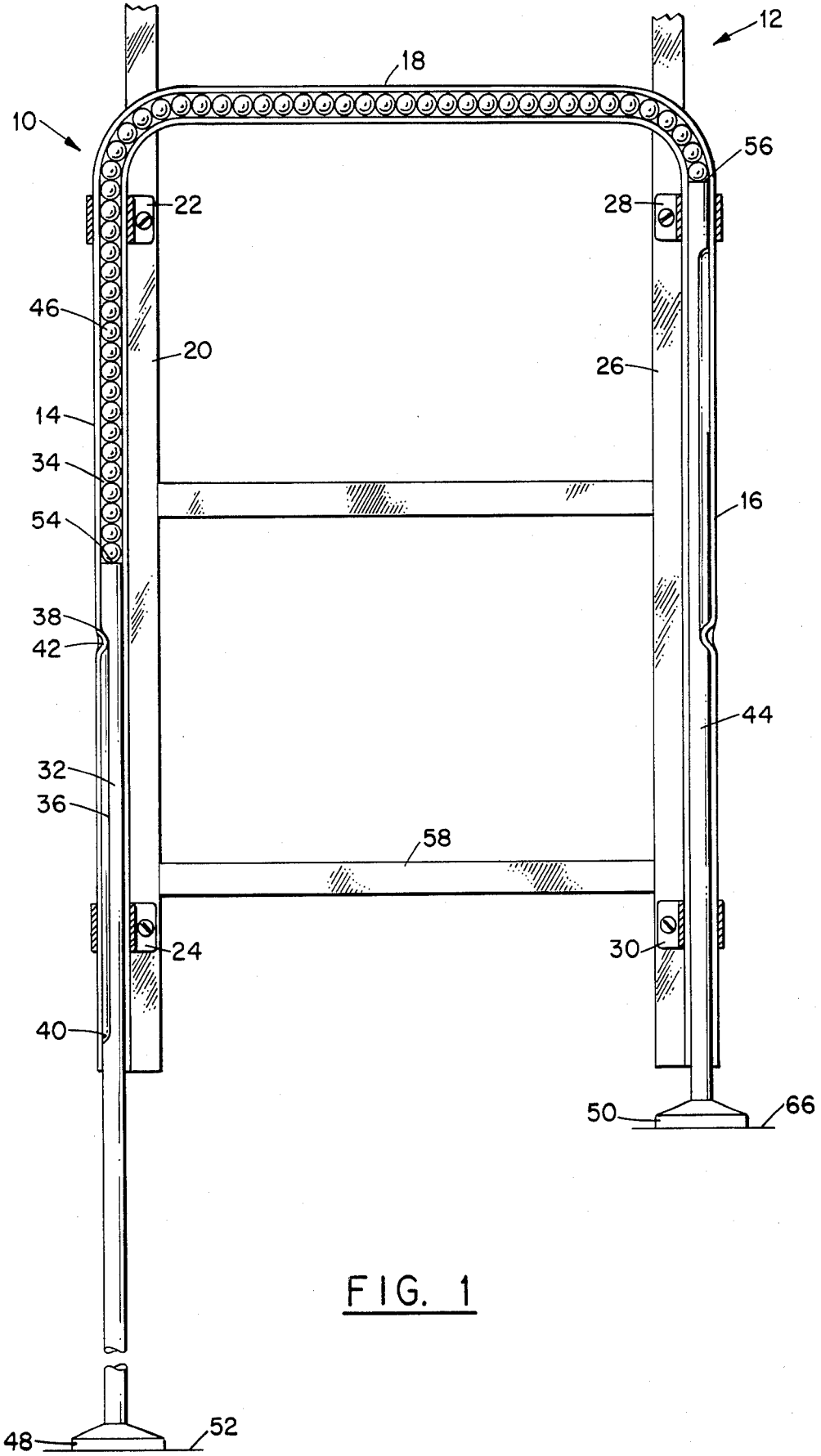
FIG. 1 is a partial side elevational view of the self-adjusting ladder mechanism of the present invention.

Referring now more particularly to FIG. 1 there is shown self-leveling attachment 10 coupled to ladder 12. The self-leveling attachment is generally U-shaped having parallel hollow channels 14 and 16. These hollow channels are connected together at their tops by, in this embodiment, a rigid hollow bridge channel 18. The bridge channel is rigid normally when the invention is used in conjunction with the manufacture of a new ladder. The channel 14 is coupled to leg 20 of ladder 12 by means of U bolts 22 and 24. Channel 16 is coupled to leg 26 of ladder 12 by means of U bolts 28 and 30. Bridge channel 18 bridges across the ladder approximately along one of the ladder steps so that it will not interfere with the normal operation of the ladder. Leg 32 is slidably received in channel 34 which is formed on the inside of tube 14. Thus the diameter of rod 32 is slightly smaller than the inside diameter of channel 34. Rod 32 includes a flattened section 36 which runs along the outside portion of the rod between positions 38 and 40 on the rod. Tube 14 is detented or dimpled as shown by dimple 42 so that shoulder 38 will abut against the dimple. Thus the rod will not fall out of the ladder when it is picked up. Rod 44 and tube 16 are constructed identically to rod 32 and tube 14 and thus will not be further expanded upon.

Figure 2:
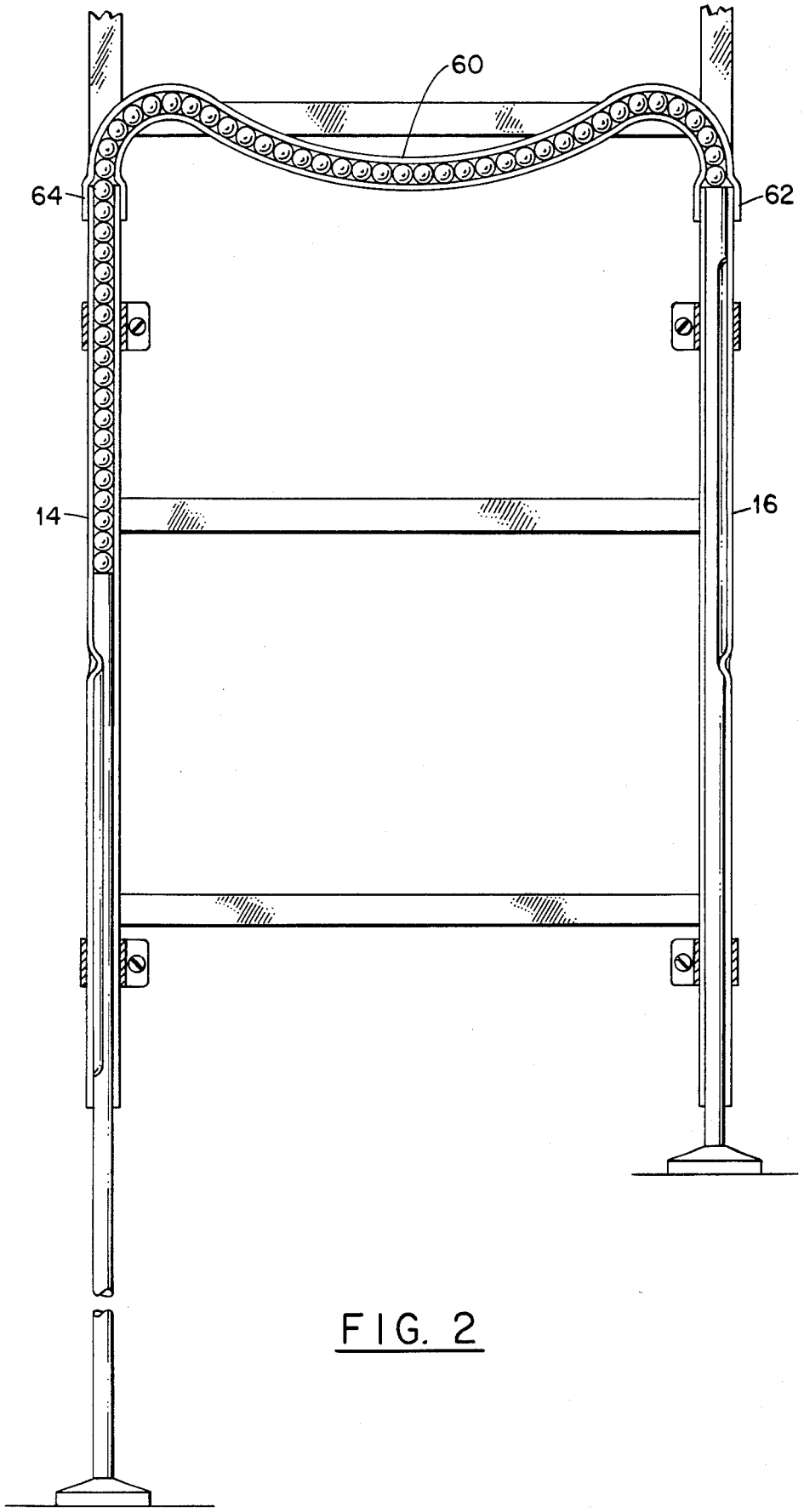
FIG. 2 shows a partial side elevational view of an alternative embodiment of the self-adjusting ladder mechanism of the present invention.

In this embodiment a plurality of steel balls 46 are movably received in bridge channel 18, as well as the channel formed by tubes 14 and 16. The diameters of the balls are slightly smaller than the inside diameters of the tube. When the feet 48 and 50 of the are positioned on surfaces which are not parallel, such as that shown in FIG. 1, the rods and balls will act to self-adjust the ladder. That is, rod 32 will extend downwardly to meet the surface 52 and rod 44 will also extend downwardly to meet surface 54, this of course due to gravity. The balls will follow the top portions 54 and 56 of the rods depending on the level of the feet 48 and 50. When a person mounts the first rung 58 of the ladder the steel balls will compress together because of the force applied by the tops of the rods 54 and 56 forming a U-shaped rigid structure among the rods and balls. It has been shown that the ladder will firmly support a man climbing it in the configuration shown in FIG. 1 with the leg 32 substantially extended and the leg 44 hardly extended at all. The embodiment shown in FIG. 2 is substantially similar to that shown in FIG. 1 except that the bridge channel 60 is made of a flexible material such as nylon or teflon tubing in lieu of the rigid metal tube 18 shown in FIG. 1. Thus this flexible tubing may be extended to different widths depending on the width of the particular ladder. Furthermore, the tubing 60 is mechanically coupled to parallel channels 14 and 16 by means of couplers 62 and 64. Thus there has been provided a truly self-leveling ladder without the need for imprecise and cumbersome discreet ratchets or holes for providing the adjustment. Furthermore, the device may be utilized on new ladders or retrofitted to various sizes of existing ladders.

Another distinct advantage of the device over prior art discreetly adjustable ladders is its suitability for use on soft surfaces such as sand or moist earth. Should either foot of the ladder sink into the soft surface after a person has ascended the ladder, the legs will automatically self-adjust to their new positions. The entire ladder will settle a bit but it will do so in a straight downward direction with no tendency to tip sideways placing the occupant in a potentially hazardous situation. This is definitely not true of prior art ladders which employ discreet incremental adjustments because the level of adjustment is locked into place prior to the person ascending the ladder.

From the foregoing description of the preferred embodiment of the invention, it is apparent that many modifications may be made therein. Thus, it is intended in the appended claims to cover all such modifications that fall within the true spirit and scope of this invention.

I claim:

1. A mechanism for making a ladder self-adjusting, comprising:

a U-shaped hollow tubular member adapted to be rigidly coupled to the bottom portion of the ladder, the tubular member including a pair of parallel channels and a bridge channel connecting the tops of the parallel channels, said bridge channel being flexible so that the mechanism may be utilized with ladders of varying widths; a pair of rods slidably received in each of said parallel channels, a plurality of balls movably received in said bridge channel and said parallel channels, said balls not being coupled to one another and adapted to freely and independently roll in said channels, the inside surfaces of said channels where said balls are located are substantially smooth, the far ends of each of said rod adapted to contact normal supporting surfaces for the ladder, a portion of each rod extending from the open end of the respective channel, the length of the portion of each rod which extends from the open end of each of said channels depending upon the relative level of the respective surface of which each of said rod contacts, said mechanism providing infinite levels of adjustment over its total range of adjustment.

* * * * *